United States Patent [19]

Perrine

[11] Patent Number: 4,629,183

[45] Date of Patent: Dec. 16, 1986

[54] ARM SUPPORT DEVICE

[75] Inventor: Walter E. Perrine, North Hollywood, Calif.

[73] Assignee: Weider Health and Fitness, Woodland Hills, Calif.

[21] Appl. No.: 639,249

[22] Filed: Aug. 9, 1984

[51] Int. Cl.[4] ..... A63B 13/00

[52] U.S. Cl. ..... 272/123; 272/119

[58] Field of Search ..... 272/119, 123; 128/78, 128/87 B, 133, 134, DIG. 19; 873/189 R, 189 A; 273/54 B

[56] References Cited

U.S. PATENT DOCUMENTS

| | | | |
|---|---|---|---|
| 607,666 | 7/1898 | Smith | 128/87 |
| 2,229,271 | 1/1941 | Anderson | 128/87 X |
| 3,099,448 | 7/1963 | Salvo et al. | 273/54 B |
| 3,419,277 | 12/1968 | Martin | 273/189 |
| 3,724,846 | 4/1973 | Perrine | 272/123 X |
| 4,245,841 | 1/1981 | Owens, Jr. | 273/189 X |
| 4,299,210 | 11/1981 | Santy | 128/87 |
| 4,373,517 | 2/1983 | Criscuolo | 128/78 X |

*Primary Examiner*—Richard J. Apley
*Assistant Examiner*—Robert W. Bahr
*Attorney, Agent, or Firm*—Blakely, Sokoloff, Taylor & Zafman

[57] ABSTRACT

A yoke weight lifting yoke supported by a harness is disclosed having a body member and pivotable, adjustable arm supports for pivoting to a comfortable angle with respect to the user's arms and for adjusting the height of the arm support with respect to the body member to properly align on the user's arms to prevent obstruction of the movement of the user's arms during weight lifting exercises such as bicep curls and tricep extensions.

16 Claims, 12 Drawing Figures

ARM SUPPORT DEVICE

FIELD OF THE INVENTION

This invention relates to a weight lifting device and more particularly to a weight lifting yoke for supporting the arms of a user in position for bicep curling and tricep extension exercises.

DESCRIPTION OF THE PRIOR ART

There are two major muscle groups in the upper arm, the biceps in the front, and the triceps in the back. To exercise those muscles, many weight lifters perform arm curls to develop the biceps and tricep extensions to develop the triceps.

To perform the arm curl, a weight lifter standing upright with a barbell in his hands and his arms extended downward at his sides, curls the barbell upward toward his chest. During this movement, there is a tendency for the weight lifter's elbows to be forced backward so that the barbell is brought closer to the chest. This backward movement of the elbows makes the curling exercise easier and less effective by bringing other muscles into play. The curl exercise is also made easier and less effective if the weight lifter uses his whole body to jerk the weights up to a curled position, rather than using only his biceps.

These problems with curling exercises were alleviated to some extent by U.S. Pat. No. 3,724,846 entitled "Lifting Yoke and Harness" relating to a weightlifting yoke which supports a user's arms in position next to his body to prevent his elbows from moving backward during the exercise. The yoke comprised a U-shaped body member for surrounding the user's chest, two arm support members, one arm support member integrally fixed to each end of the body member for supporting the user's arms, and a harness means for supporting the yoke on the user.

Despite the vast improvement of this device over the prior art, certain problems have been observed. One problem is that the arm support members are fixed in position relative to the body member so that some users experience discomfort to the backs of their arms at the point of contact with the arm support members. This discomfort is generally due to the fact that the arm supporting surface of the arm support members are not parallel to the back of the user's arms so that generally, the upper edge of the arm support member cuts into the back of the user's arm.

Another problem with this prior art device is that it is basically only useful for arm curling exercises and cannot be used for tricep extension exercises. To perform tricep extensions, the user bends forward at the waist with his upper arms parallel and aside his upper body and his lower arms hanging vertically downward therefrom. The user holds a dumbbell in each hand and flexes his triceps to straighten his arms, thereby moving the dumbbells upward and backward. The triceps are then relaxed somewhat to allow the lower arms to drop back to the vertical position. As with the curling exercises, there is a tendency for the arms to be pulled out of position, in this case, to be pulled straight down from the shoulders. There may also be an excessive strain on the user's shoulders in holding the upper arms in place.

Using the prior art lifting yoke, proper positioning of the arm support member across the bicep, which is critical to allow free movement of the arms, cannot be achieved. When the body member is comfortably disposed across a user's back in a position which does not interfere with the user's arm pits, the arm support members which are aligned with the body member are disposed too low, specifically, over the inside of the user's elbow, thereby preventing the user from bending his elbow. Conversely, when the arm support members are properly disposed across the bicep to freely allow arm movement, the body member is disposed too high, specifically, across the user's back, such that it cuts into the user's arm pits thereby causing discomfort.

As used herein, the term "weight lifter" refers to all persons who use barbells and or dumbbells for any purpose, whether it is for power lifting, body building, or other types of conditioning or training.

SUMMARY OF THE INVENTION

The present invention is an improved weight lifting yoke comprising a U-shaped body member for surrounding either a user's chest or back, arm support members pivotably coupled to each end of the body member for allowing the arm support members to pivot with respect to the body member to a position most comfortable on a user's arm and a harness means for holding the yoke in position on the user. The invented yoke can be provided with a locking means for securing the arm support members in a preferred position, or the arm support members can be allowed to freely pivot.

The present invention can also be used for tricep extension exercises. The tops of the arm support members are raised above the level of the body member so that when the body member is disposed across a user's back, the arm support members are disposed in front of the user's biceps without interfering with the bending of the user's arms. In this arrangement, the body member does not cause any discomfort to the the user's arm pits.

DETAILED DESCRIPTION

Figure 1:
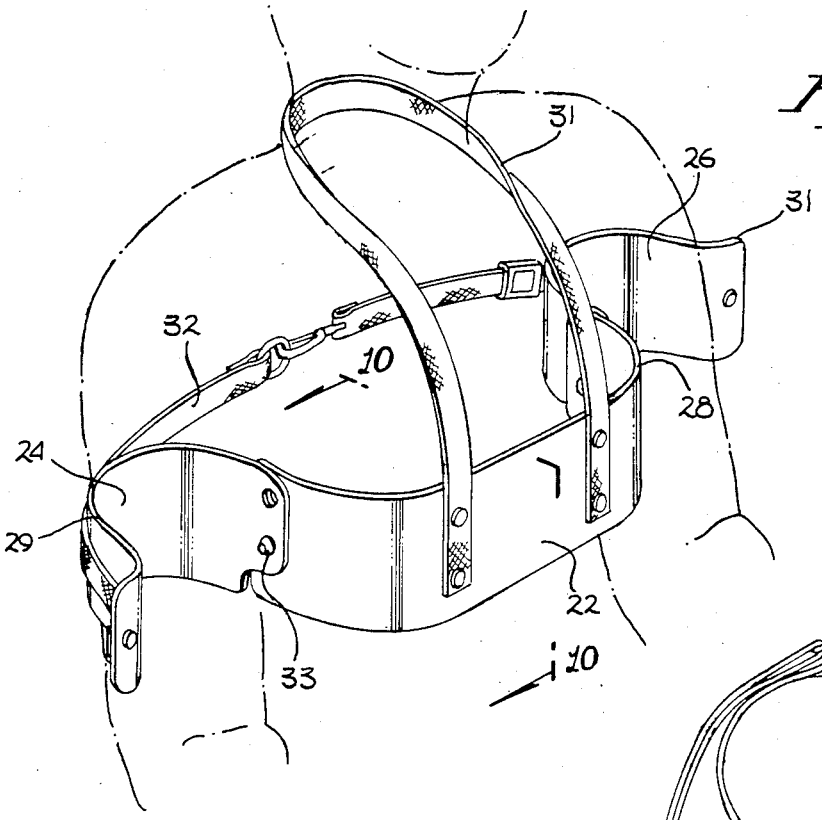
FIG. 1 is a perspective view of the present invention installed on a user for bicep exercises.

Referring first to FIG. 1, the improved yoke 20 generally comprises a body member 22, and a first arm support member 24 and a second arm support member 26 removably and adjustably attached to the ends thereof. A harness means 31 is attached to the yoke 20 and can be used to support the yoke in position on a user 28. A belt means 32 is also provided to hold the yoke 20 in position on the user 28.

Figures 2, 9:
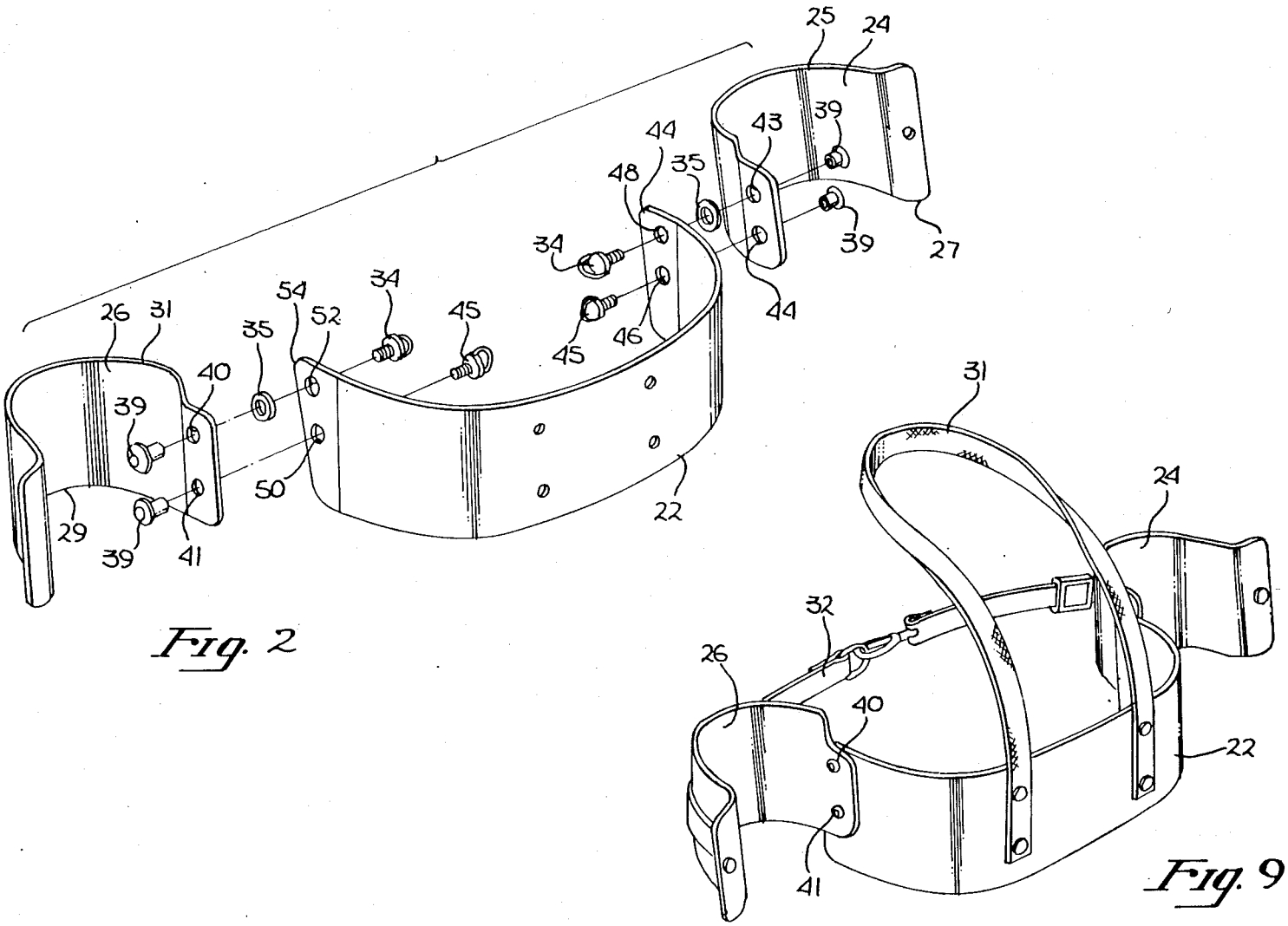
FIG. 2 is an exploded perspective view of the present invention.
FIG. 9 is a perspective view of the present invention with the arm support member in a raised position.

Referring now to FIG. 2, the body member 22 has an upper 48 and lower 46 hole near the first end 44, and a similarly positioned upper 52 and lower 50 holes near the second end 54 thereof. Correspondingly, arm support member 26 has a medially disposed first hole 40 and second hole 41 disposed close to a corner of the arm support member 26. Similarly, arm support member 24 has medially disposed a first hole 43 and a second hole 44 disposed close to the corner of arm support member 24. The upper and lower holes on each end of the body member 22 are the same distance apart as the first and second holes on each of the arm support members.

Figure 8:
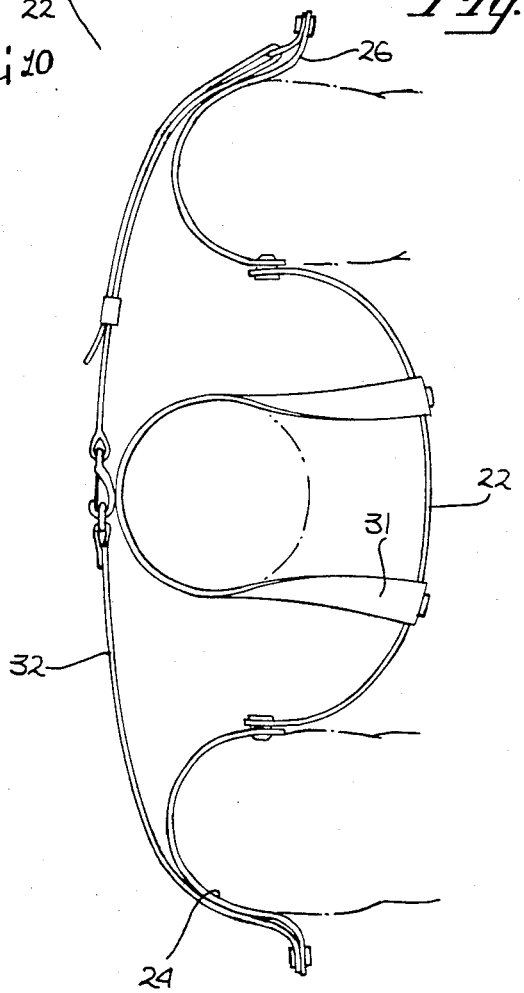
FIG. 8 is a plan view of the present invention installed on a user for bicep exercises.
Figure 7:
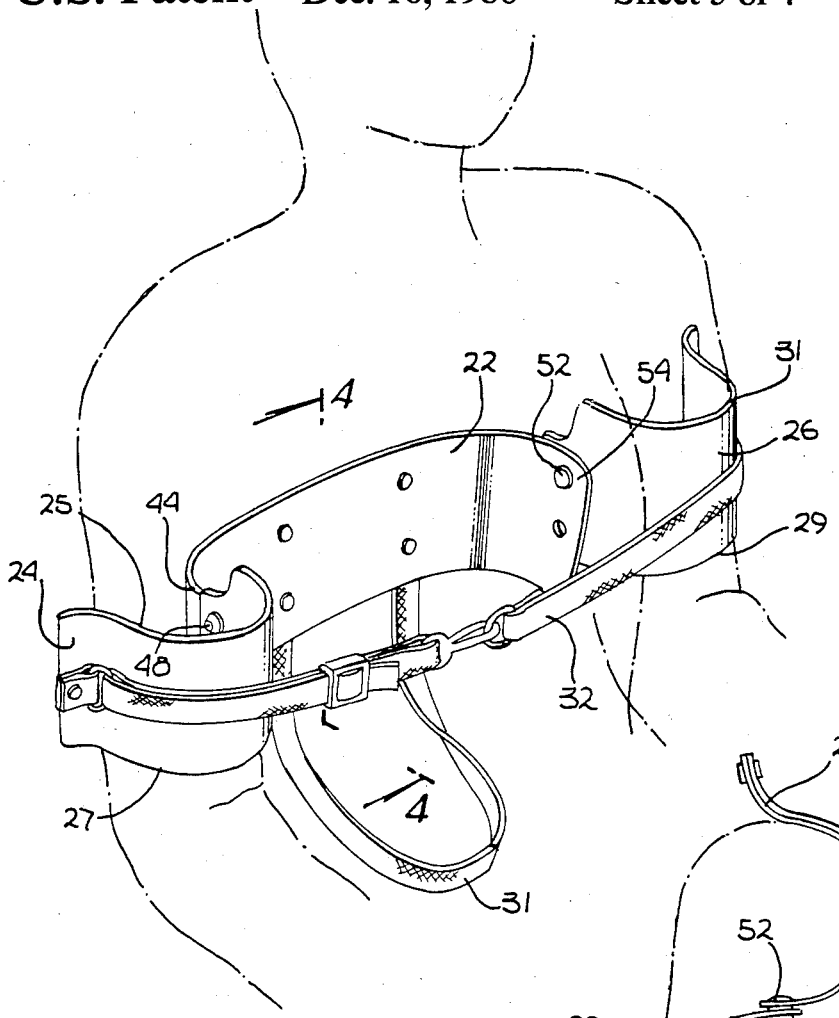
FIG. 7 is a perspective view of the present invention installed on a user for tricep exercises.

The device as shown in FIGS. 1 and 8 is particularly suited for bicep curls. The top 28 of body member 22 is approximately disposed at the same level as the tops 29 and 31 of arm support members 24 and 26 respectively. Conversely, as shown in FIGS. 7 and 9 arm support members 24 and 26 are raised above the level of body member 22. FIG. 7 shows the raised mode of the invented yoke for you in tricep extension exercises. FIG. 9 shows the raised mode for use in doing bicep curls.

Figure 10:
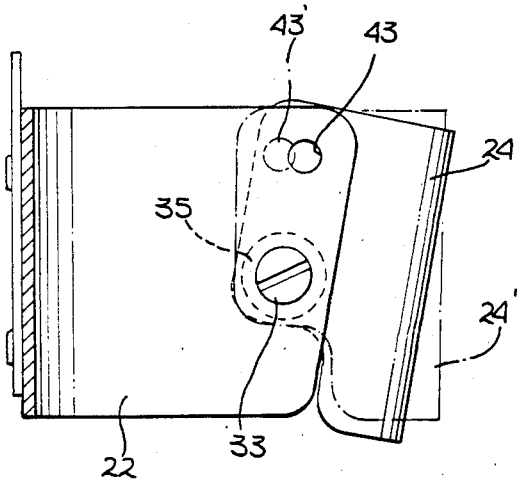
FIG. 10 is a cross-sectional view of the pivot means taken through line 10—10 of FIG. 7 illustrating the pivotable mode.
Figure 11:
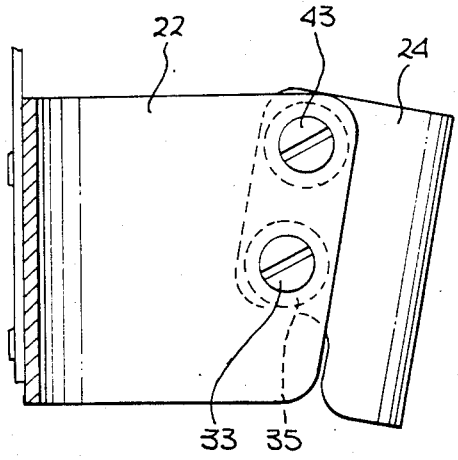
FIG. 11 is a cross-sectional view of of the pivot means shown in FIG. 10 illustrating the locked mode.

The pivoting mode of the arm support members is shown in FIG. 10. As illustrated therein a pivot means 33, which may be a bolt, screw or pin is inserted through lower holes 44 and 46 in arm support member 24 and body member 22, respectively. A washer 35, preferably self-lubricating, is disposed between the arm support member 24 and the body member 22 to permit slippage therebetween. The pivot tension holding the arm support member 24 and the body member 22 together is adjustable so that the user can select the tension required to pivot the arm support member. For example, as shown in FIG. 10, the arm support member 24 can pivot about pivot means 33 to position 24', and first hole 43 pivots to position 43'.

Figure 6:
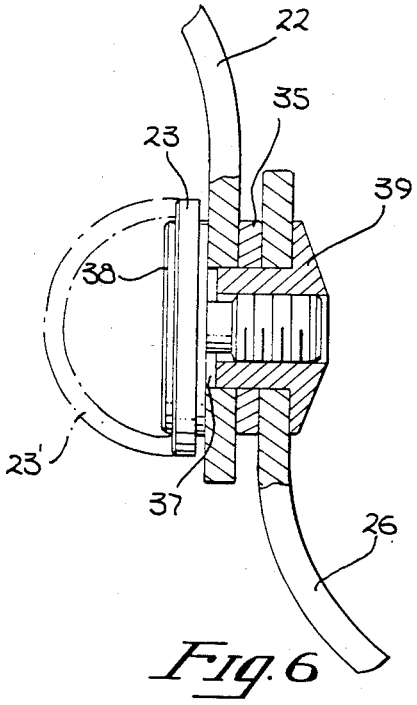
FIG. 6 is an enlarged cross-sectional view of the pivot means.

FIG. 6 illustrates the preferred pivot means. As shown therein, the pivot means comprises generally a flat head screw 38 and nut 39. Screw 38 has a hinged handle 41 thereon, which can be rotated to a position 41' tangential to the plane of the screw head to facilitate the tightening and loosening of the screw 38 by hand. There is preferably a space 37 between the nut 39 and screw 38 to permit maximum tightening thereof. Washer 35 separates body member 22 from arm support member 24. By fully tightening the screw 38 and nut 39, the arm support member can be virtually locked in any predetermined position.

Figure 4:
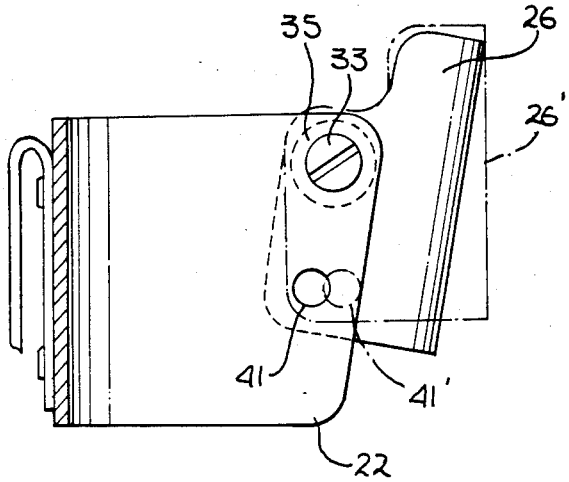
FIG. 4 is a cross-sectional view of the present invention taken through line 4—4 of FIG. 3 illustrating the pivot means in the pivotable raised mode.
Figure 5:
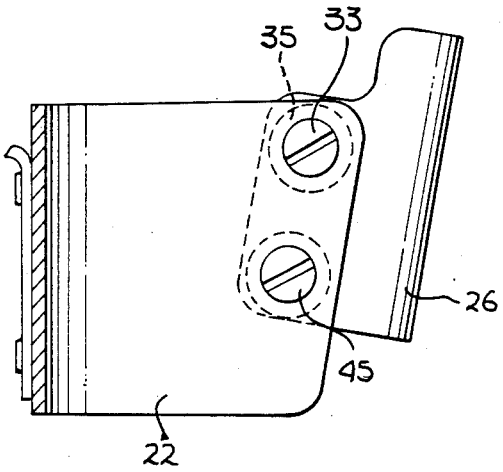
FIG. 5 is a cross-sectional view of the pivot means illustrating the locked raised mode.

As shown in FIGS. 4 and 5, similar to FIGS. 9 and 10 described above, there are two modes of operation of the invented yoke with the arm support members in the raised position. FIG. 4 shows the pivotable mode in which a single pivot means 34 is disposed through the arm support member 26 and the body member 22. The arm support member 26 can pivot in this mode about the pivot means, for example, from position 26 to 26'. FIG. 5 illustrates the locked mode in which the arm support members are locked in position. A locking member 45 comprising a bolt, pin, screw or the like is disposed through the arm support member 26 and the body member 22 to fix the arm support member in position thereby preventing its pivoting.

In another mode of operation as shown in FIGS. 2, 4, 5, 7, 9 and 12, the tops 31 and 25 of arm support members 26 and 24 respectively are positioned above the top 28 of the body member 22 to a raised position. This mode of operation should be compared with the device as arranged in FIG. 1. To achieve this position, the arm support member 24 in FIG. 1 is removed from end 54 of the body member 22 and secured to end 44, by turning it upside down, so that second hole 44 which was previously disposed above first hole 43, is now disposed below first hole 43. Arm support member 26 is similarly removed from end 37, turned upside down, and secured to end 54.

The exact position to which the arm support members 24 and 26 pivot for most comfortable positioning is generally a function of the physiology of the user. Different users have their shoulders positioned more forward or backward with respect to their chests, relative to other users, such that the position and angle of their arms with respect to the arm support members varies greatly. Thus, using the prior art device, if the users shoulders are set further back, his arms will be angled such that the back of his arms will press against the top edge of the arm support member. Conversely, if the user's shoulders are relatively forward, the backs of the user's arms would be pressed against the bottom edge of the arm support members of a prior art device. The present invention allows the arm support members to pivot so that the backs of the user's arms are flush against the arm support members, without causing any discomfort.

One particular advantage of the present invention is that it is self-adjusting in that the arm support members will be forced by the user's arms to the most comfortable position for an individual user. Moreover, as the topology of the muscle adjacent the arm support member changes during extension or contraction, the angle of the arm support members can also adjust correspondingly to conform to the most comfortable position for the user. Thus, when the body member 22 is comfortably installed across the user's back without interfering with the user's arm pits, the arm support members are comfortably disposed across the user's biceps such that the user can bend his arms without interference. In this position, arm support members 24 and 26, should be positioned slightly above the inside of the user's elbow.

The invented yoke can be formed of metal, such as steel, aluminum, or similar metal, fiberglass, or similar material that can withstand the stress imposed by its use without undue flex. The material should preferably be of light weight so that it can be easily transported and comfortably worn.

The harness means 31 preferably comprises a strap attached to the body member 22 at positions equidistant from the center thereof and is preferably of adjustable length so that the arm support members can be set at a suitable height for a particular user.

The belt 32 is also preferably of adjustable length to fit any user. The belt is preferably fitted with a clasp therein to facilitate attachment and removal thereof.

To provide additional comfort to the user, padding may be installed on the surface of the arm support members which abut the user's arms. The pad can be a foam, cloth material or the like.

To use the invented device for arm curls, the user places the harness means 31 around his neck, and attaches the belt 32 around his back, although the use of the belt is optional. The length of the harness means should be adjusted so that the arm support members 24 and 26 are positioned at a comfortable height against the back of the upper arm of the user.

The pivot means is loosened to enable the arm support members to pivot to a comfortable position as a result of pressure from the user's arms. The invented yoke enables the user to isolate his biceps in performing arm curls. In addition, less strain is created on the shoulders and back relative to performing the exercise without using the device. Moreover, the user's arms are substantially more comfortable.

Figure 12:
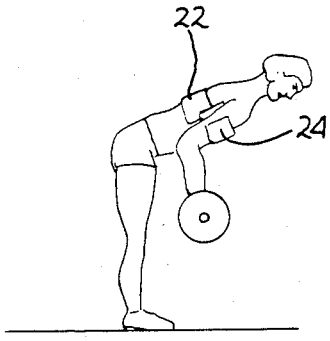
FIG. 12 is a side view of the present invention installed on a user for tricep exercises.
Figure 3:
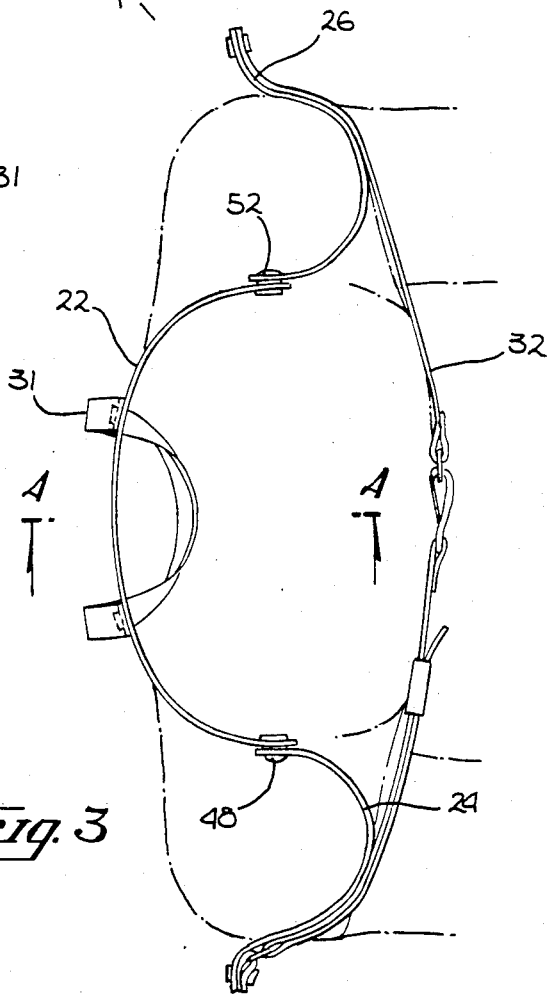
FIG. 3 is a plan view of the present invention installed on a user for tricep exercises.

Using the invented device for tricep extensions, the user installs the invented yoke device as shown in FIG. 12, with the body member 22 extending around the user's back and the user's arms positioned in and behind the arm support members 26 and 24 (not shown). The harness means 31 is not used because for this position, the harness would wrap around the user's neck thereby possibly choking him. Instead, the belt means 32 is used to hold the yoke in place. The user bends at the waist, holding one dumbbell in each hand, with his arm relaxed in a vertical position. The user flexes his triceps thereby pushing the dumbbells upward and backward in the direction indicated by the arrow. The user then releases the tension in his triceps and his forearms drop to a vertical position. The user's upper arms are maintained in position next to the user's sides and are thus restrained by the invented yoke from being parallel downward by the weights. Similarly, there is no strain on the user's shoulders, the triceps being isolated by the present invention and the weight being distributed across the user's back.

The present invention may be carried out in other specific ways than those set forth herein without departing from the spirit and essential characteristics of the invention. The present embodiments are, therefore, to be considered in all respects as illustrative and not restrictive, and all changes coming within the meaning and equivalence of the appended claims are intended to be embraced therein.

I claim:

1. A yoke for supporting a user's arms in fixed positions, said yoke comprising:

a rigid contoured U-shaped body member for partially extending around the upper body of a user, said body member having a first and second end;

a first and second arm support member, each of said arm support members having a first portion for supporting a user's arms in a predetermined position, and a second portion adjacent a respective end of said U-shaped body members;

a harness means coupled to said body member for supporting said body member at a predetermined position on the user's body; and a pivot means selectively pivotably coupling said second portions of said first and second arm support members to the respective one of said first and second ends of said body member for relative rotation therebetween about a substantially horizontal axis through an arc of sufficient length for positioning the arms of different users in a comfortable position for performing arm exercises.

2. The yoke of claim 1 wherein said arm support members are demountably and adjustably coupled to said body member such that said arm support members can be coupled to said body member to align with a user's biceps when said body member is installed across said user's back.

3. The yoke of claim 1 wherein said pivot means comprises at least one bolt extending through a pivot axis of said arm support member, and a washer disposed between said arm support member and said body member.

4. The yoke of claim 1 wherein said pivot means comprises first holes disposed in predetermined positions in said first and second arm support members and corresponding holes in said body member, and a first pivot extending through said hole in said first arm support member and said corresponding hole in said body member, and a second pin extending through said second arm support member and said corresponding hole in said body member.

5. The yoke of claim 4 wherein pivot means further comprises a tension adjustable bolt through said second holes for adjusting the friction between said arm support members and said body member such that said arm support members can either pivot or be in a fixed position.

6. The yoke of claim 1 further comprising a locking means for securing said arm support members in a predetermined position with respect to said body member.

7. A yoke for supporting a user's arms in position during weight lifting exercises, said yoke comprising:

a rigid, U-shaped body member for extending around the chest or back of said user, said body member having a first and second end and a plurality of holes approximately vertically disposed near said first and second ends, first and second arm support members for extending around the front or back of the upper arms of user, said arm support members having a plurality of holes therethrough corresponding to said plurality of said holes in said body member, each of said arm support members having as first portion for supporting a user's arms in a predetermined position and a second portion adjacent a respective end of said U-shaped body member;

pivot means for selectively pivotably coupling said second portion of said first and second arm support members to the respective one of said first and second ends of said body member for relative rotation therebetween about a substantially horizontal axis though an arc of sufficient length for positioning the arms of different users in a comfortable position for performing arm exercises, said pivot means comprising at least one pin extending through at least one of said plurality of said holes in said body member and said arm support member; and a harness means coupled to said body member for supporting said body member on a user;

whereby when said body member is disposed around a user's chest, said arm support members are aligned with said body member and surround the back of a user's upper arms for performing bicep curls, and when said body member is disposed around a user's back, said arm support members surround the front of a user's upper arms for performing tricep extension exercises; and whereby said arm support members are pivotable with respect to said body member through said substantially horizontal axis.

8. The yoke of claim 7 wherein said pivot means is adjustable so that said arm support means can be raised with respect to said body member.

9. The yoke of claim 8 wherein when said yoke is used for tricep extension exercises, said arm support members are raised to a position above said body member and secured thereto by said adjustable pivot means.

10. The yoke of claim 9 wherein said arm support members are rotatable 360° about said pivot means such that said arm support members are pivotable to an angular position comfortable to the upper arms of a user by the pressure of said user's arms thereon.

11. The yoke of claim 10 wherein said pivot means comprises at least one removable pin extending through adjacent holes in said body member and said arm support members.

12. The yoke of claim 11 wherein said removable pin can be tightened to create sufficient resistance between said arm support members and said body member such that said body member can be fixed in position.

13. The yoke of claim 9 wherein said pivot means comprises a plurality of removable pins.

14. A yoke for supporting a user's arms in position during weight lifting exercises comprising:

a rigid, U-shaped body member for extending around the chest or back of a user, said body member having a first and second end and two vertically aligned holes near said first and second ends;

first and second U-shaped arm support members for extending around the front or back of the upper arms of a user, said arm support members having two holes corresponding to said holes near said first and second ends of said body member;

at least one removable pivot extending substantially horizontally through one of said holes in each of said arms support members and said corresponding hole in said body member, to provide relative rotation of said first and second U-shaped arm support members about a substantially horizontal axis through an arc of sufficient length for positioning the arms of different users in a comfortable position for performing arm exercises, said pivot having means for selectively adjusting the friction between said body member and said arm support member to adjust the freedom of pivoting therebetween;

harness means coupled to said body member for supporting said yoke in position on a user; and, adjustable elastic belt means coupled to said body member for surrounding the back or chest of user to support the yoke thereon, whereby when said body member is disposed around a user's chest, said arm support members are aligned with said body member and surround the back of a user's upper arms for performing bicep curls, and when said body member is disposed around a user's back, said arm support members surround the front of a user's upper arms for performing tricep extension exercised; and whereby said arm support members are pivotable with respect to said body member.

15. The yoke of claim 14 further comprising a locking means for securing said arm support members in predetermined position with respect to said body member.

16. The yoke of claim 15 wherein said locking means comprises locking pins disposed through said arm support member and said body member near said pivot.

* * * * *